US011813877B2

(12) United States Patent
Kanahara

(10) Patent No.: US 11,813,877 B2
(45) Date of Patent: Nov. 14, 2023

(54) RECORDING DEVICE

(71) Applicant: SEIKO EPSON CORPORATION, Tokyo (JP)

(72) Inventor: Shunsuke Kanahara, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 45 days.

(21) Appl. No.: 17/656,714

(22) Filed: Mar. 28, 2022

(65) Prior Publication Data

US 2022/0305803 A1 Sep. 29, 2022

(30) Foreign Application Priority Data

Mar. 29, 2021 (JP) ..... 2021-054787

(51) Int. Cl.
*B41J 2/185* (2006.01)
*B41J 2/17* (2006.01)

(52) U.S. Cl.
CPC ..... *B41J 2/185* (2013.01); *B41J 2/1721* (2013.01); *B41J 2002/1735* (2013.01); *B41J 2002/1856* (2013.01)

(58) Field of Classification Search
CPC ..... B41J 2002/1856; B41J 2002/1742; B41J 2002/1735; B41J 2002/1728; B41J 2002/16594; B41J 2/185; B41J 2/1721; B41J 2/16523; B41J 2/1652; B41J 2/16526; B41J 2/16532; B41J 2/16517
See application file for complete search history.

(56) References Cited

U.S. PATENT DOCUMENTS 10,717,284 B1 * 7/2020 Shelhart ..... B41J 2/16532
2009/0231388 A1 * 9/2009 Osumi ..... B41J 2/16523 347/36
2010/0074802 A1 3/2010 Yasuda
2013/0100202 A1 4/2013 Ogasawara

FOREIGN PATENT DOCUMENTS

JP 2008-132410 A 6/2008
JP 2013-086423 A 5/2013

* cited by examiner

*Primary Examiner* — Jannelle M Lebron
(74) *Attorney, Agent, or Firm* — WORKMAN NYDEGGER

(57) ABSTRACT

A printer includes a recording unit, a platen unit, a maintenance tank, and a guide unit. The recording unit ejects ink onto a medium. The platen unit includes a support surface that supports the medium and a discard portion in which waste ink is discarded. The maintenance tank recovers the waste ink. The guide unit has a receiving surface, and guides the waste ink to the maintenance tank. Second surface energy is larger than first surface energy when the first surface energy indicates surface energy at a first position on the receiving surface with respect to the waste ink and the second surface energy indicates surface energy at a second position closer to the maintenance tank than the first position.

7 Claims, 8 Drawing Sheets

RECORDING DEVICE

The present application is based on, and claims priority from JP Application Serial Number 2021-054787, filed Mar. 29, 2021, the disclosure of which is hereby incorporated by reference herein in its entirety.

BACKGROUND

1. Technical Field

The present disclosure relates to a recording device.

2. Related Art

A recording device described in JP-A-2018-86423 includes a waste ink receiving unit having a first inclination surface and a waste ink receiving surface. Waste ink landing on the first inclination surface flows onto the waste ink receiving surface due to its own weight, and is absorbed in a porous sheet attached to the waste ink receiving surface via a double-sided tape or the like.

The recording device in JP-A-2018-86423 has a mechanism of recovering waste ink flowing on the inclination surface, and hence the inclination surface needs to be steeper so that waste ink landing on the inclination surface is reliably caused to flow thereon.

However, when the inclination surface is steeper, a height dimension of the recording device tends to be increased.

SUMMARY

In order to solve the above-mentioned problem, a recording device according to the present disclosure includes a recording unit configured to eject liquid onto a medium to perform recording on the medium, the medium being transported in a transport direction, a support unit including a support surface configured to support the medium and a discard portion being provided at a position corresponding to an end edge of the medium supported on the support surface in a width direction, the width direction being a direction intersecting with the transport direction of the medium, the discard portion being a portion in which waste liquid being the liquid not used for recording on the medium is discarded, a recovery unit configured to recover the waste liquid, and a guide unit configured to receive the waste liquid flowing out from the discard portion and guide the waste liquid so that the waste liquid flows toward the recovery unit, wherein the guide unit includes a receiving surface for receiving the waste liquid, and when surface energy at a first position on the receiving surface for the waste liquid is first surface energy, and surface energy at a second position on the receiving surface for the waste liquid is the second surface energy, the second position being closer to the recovery unit than the first position, the second surface energy is larger than the first surface energy.

DESCRIPTION OF EXEMPLARY EMBODIMENTS

Figure 1:
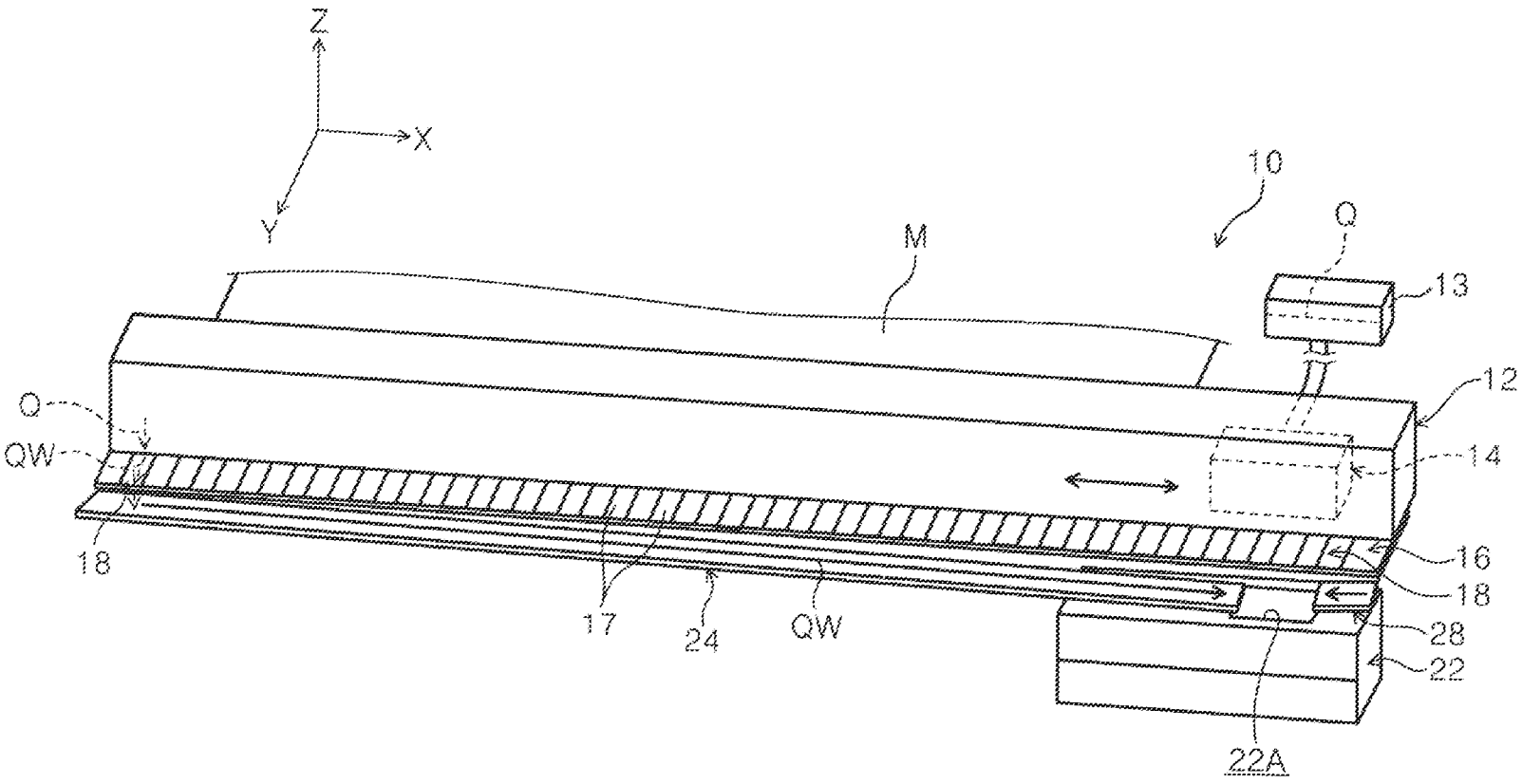
FIG. 1 is a perspective view of a printer of a first exemplary embodiment.

Now, the present disclosure is schematically described.

In order to solve the above-mentioned problem, a recording device according to a first aspect of the present disclosure includes a recording unit configured to eject liquid onto a medium to perform recording on the medium, the medium being transported in a transport direction, a support unit including a support surface configured to support the medium and a discard portion being provided at a position corresponding to an end edge the medium supported on the support surface in a width direction, the width direction being a direction intersecting with the transport direction of the medium, the discard portion being a portion in which waste liquid being the liquid not used for recording on the medium is discarded, a recovery unit configured to recover the waste liquid, and a guide unit configured to receive the waste liquid flowing out from the discard portion and guide the waste liquid so that the waste liquid flows toward the recovery unit, wherein the guide unit includes a receiving surface for receiving the waste liquid, and when surface energy at a first position on the receiving surface for the waste liquid is first surface energy, and surface energy at a second position on the receiving surface for the waste liquid is the second surface energy, the second position being closer to the recovery unit than the first position, the second surface energy is larger than the first surface energy.

According to the present aspect, the waste liquid that is not used for recording on the medium is discarded in the discard portion. The waste liquid flowing out from the discard portion and arriving at the receiving surface is easily guided because a driving force acts on the receiving surface from the first position having small surface energy to the second position having large surface energy. With this, even when inclination of the guide unit with respect to a horizontal direction is reduced, the waste liquid can be guided to the recovery unit. Thus, the dimension of the recording device can be reduced as compared to a case in which the waste liquid is guided by increasing the inclination angle of the guide unit.

In the first aspect, a recording device according to a second aspect further includes a second guide unit including a second receiving surface for receiving the waste liquid when the guide unit is a first guide unit and the receiving surface is a first receiving surface, wherein when a direction in which a gravitational force acts on the waste liquid is a gravitational direction, the second guide unit is positioned below the first guide unit in the gravitational direction, and when a direction in which the waste liquid is guided from the first position to the second position is a guide direction, an edge portion downstream of the first guide unit in the guide direction overlaps with the second receiving surface in plan view in the gravitational direction.

A guiding action to the waste liquid, which is exerted by of the first guide unit, may be weakened when wetting of the waste liquid is increasingly spread.

According to the present aspect, the second guide unit is capable of additionally applying a guiding action to the waste liquid, and hence the waste liquid can be prevented from stagnating in the middle of the guide unit.

In the second aspect, in a recording device according to a third aspect, the edge portion downstream of the first guide unit in the guide direction includes a curved portion being curved toward the second receiving surface.

According to the present aspect, the waste liquid arriving at the edge portion downstream of the first guide unit flows to the second receiving surface via the curved portion. With this, the waste liquid from the edge portion downstream of the first guide unit in the guide direction can be easily introduced to the second receiving surface.

In the third aspect, in a recording device according to a fourth aspect, an end of the curved portion is at a position away from the second receiving surface.

According to the present aspect, the curved portion and the second receiving surface are away from each other, and hence the waste liquid dropping onto the second receiving surface does not contact with the plurality of surfaces intersecting with each other. With this, movement of the waste liquid dropping onto the second receiving surface is less likely to be prevented. Thus, the waste liquid from the first guide unit in the guide direction can be easily introduced to the second receiving surface.

In any one of the first aspect to the fourth aspect, in a recording device according to a fifth aspect, wettability of the waste liquid on the receiving surface increases as a temperature rises, and the recording device further comprises a heating unit configured to heat the guide unit so that a second temperature is higher than a first temperature when the first temperature is a temperature at the first position on the receiving surface and the second temperature is a temperature at the second position on the receiving surface.

According to the present aspect, the waste liquid has such property that, when a temperature rises, wettability on the receiving surface is higher. Here, when the guide unit is heated by the heating unit, a temperature at the second position closer to the recovery unit is higher than a temperature at the first position away from the recovery unit. With this, as approaching the recovery unit, the waste liquid is more likely to wet the receiving surface. Thus, the waste liquid can be easily introduced to the recovery unit.

In the fifth aspect, a recording device according to a sixth aspect further includes an electric unit being provided with a control unit configured to control the recording unit, wherein the heating unit includes an imparting unit configured to impart, to the guide unit, at least part of exhaust heat from the electric unit.

According to the present aspect, when the control unit in the electric unit controls the recording unit, a temperature of the electric unit rises due to heat generation of the control unit. Here, the imparting unit of the heating unit imparts, to the guide unit, at least part of exhaust heat from the electric unit. Then, the guide unit is heated. With this, an additional heating source is not required for heating the guide unit, and hence energy consumption in the recording device can be reduced.

In any one of the first aspect to the sixth aspect, in a recording device according to a seventh aspect, when a direction intersecting with a direction in which the waste liquid flows is an intersecting direction, a width in the intersecting direction at the second position on the receiving surface is smaller than a width in the intersecting direction at the first position on the receiving surface.

According to the present aspect, the waste liquid flowing on the receiving surface is gathered and forms larger unity as approaching the downstream end of the receiving surface. With this, as compared to a configuration in which the receiving surface has a rectangular outer shape, the waste liquid can be prevented from stagnating at a part of the receiving surface.

First Exemplary Embodiment

A printer 10 according to a first exemplary embodiment of the present disclosure is specifically described.

FIG. 1 illustrates an entire configuration of the printer 10.

The printer 10 is one example of a recording device, and performs recording on a medium M elongated in one direction. Examples of the medium M include fiber and sheet paper. Note that an X-Y-Z coordinate system illustrated in each of the drawings is a rectangular coordinate system.

An X direction corresponds to a device width direction of the printer 10, and corresponds to a horizontal direction in one example. A base-end side of an arrow indicating the direction is defined as a −X direction, and a leading-end side of the arrow indicating the direction is defined as a +X direction. Further, the X direction corresponds to a width direction of the medium M.

A Y direction corresponds to a depth direction of the printer 10, and corresponds to the horizontal direction. A leading-end side of an arrow indicating the direction is defined as a +Y direction, and a base-end side of the arrow indicating the direction is defined as a −Y direction. The +Y direction corresponds to a direction of transporting and discharging the medium M supported on a supporting surface 17 of a platen unit 16 described later.

A Z direction is a direction orthogonal to both the X direction and the Y direction. A leading-end side of an arrow indicating the direction is defined as a +Z direction, and a base-end side of the arrow indicating the direction is defined as a −Z direction. The +Z direction corresponds to a device height direction of the printer 10, and is orthogonal to both the Y direction and the X direction.

As one example, the printer 10 includes a device main body 12, an ink tank 13, a recording unit 14, the platen unit 16, a maintenance tank 22, a guide unit 24, and a guide unit 28.

The device main body 12 includes a transport roller pair (not illustrated) that moves the medium M in the +Y direction being one example of a transport direction and a control unit (not illustrated) that controls an operation of each of the units of the printer 10.

The ink tank 13 stores ink Q being one example of a liquid. Note that the ink Q that is discarded in a discard portion 18 described above and is not used for recording is distinguished from the other ink Q, and is regarded as waste ink QW being one example of waste liquid. Further, one droplet of the waste ink QW is regarded as an ink droplet D (FIG. 3), and is distinguished from the waste ink QW.

The recording unit 14 is one example of a recording unit. The recording unit 14 is supported on the device main body 12 so as to be movable in the X direction. The recording unit 14 includes an ejection head (not illustrated) including a plurality of nozzles. While moving in the X direction with respect to the medium M transported in the +Y direction, the recording unit 14 ejects the ink Q from the ejection head onto the medium M, and thus performs recording on the medium M.

The platen unit 16 is formed as an elongated member extending in the X direction. The platen unit 16 has a width larger than the length of the medium M in the X direction. The platen unit 16 is one example of a support unit, is arranged in the −Z direction with respect to the medium M, and supports the medium M. Specifically, the platen unit 16 includes the supporting surface 17 and the discard portion 18.

The supporting surface 17 forms a part of an upper surface of the platen unit 16 in the +Z direction, and supports the medium M.

The discard portion 18 is provided at a position corresponding to an end edge in the X direction intersecting with the +Y direction of the medium M supported on the supporting surface 17. Further, when marginless recording is performed on the medium M, the discard portion 18 receives the waste ink QW ejected from the recording unit 14 on an outer side of the end of the medium M in the X direction. In other words, the discard portion 18 is a portion of the platen unit 16 in which the waste ink QW is discarded.

The discard portion 18 has a net-like structure, and the waste ink QW can pass therethrough in the −Z direction. Further, an ink absorption material (not illustrated) is provided to the discard portion 18. The waste ink QW absorbed in the ink absorption material is temporarily retained in the ink absorption material, and eventually flows down to the guide units 24 and 28 described later.

The maintenance tank 22 is one example of a recovery unit, and is capable of recovering the waste ink QW. Specifically, the maintenance tank 22 is formed to have a rectangular parallelepiped box-like shape, and is arranged at a position in the −Z direction with respect to an end of the platen unit 16 in the +X direction. A recovery port 22A that opens in the Z direction is formed in an upper end of the maintenance tank 22 in the +Z direction. The waste ink QW flowing from the guide units 24 and 28 described later passes through the recovery port 22A, and is recovered in the maintenance tank 22. Note that the recovery unit is not limited to the above-mentioned configuration. For example, there may be adopted a bottomed cylindrical member integrally formed with an end of the guide unit 24 in the +X direction, which is described later.

The guide unit 24 is at a position in the −Z direction with respect to the platen unit 16 and a position in the −X direction with respect to the recovery port 22A. Further, the guide unit 24 receives the waste ink QW flowing down from the discard portion 18, and guides the waste ink QW so that the waste ink QW flows to the maintenance tank 22.

The guide unit 28 is at a position in the −Z direction with respect to the platen unit 16 and a position in the +X direction with respect to the recovery port 22A. Further, the guide unit 28 receives the waste ink QW flowing out from the discard portion 18, and guides the waste ink QW so that the waste ink QW flows to the maintenance tank 22.

In FIG. 1, for easy understanding, the guide unit 24 and the guide unit 28 are slightly inclined with respect to the X direction, but the guide unit 24 and the guide unit 28 may be arranged along the X direction. Note that, as one example, the guide unit 24 and the guide unit 28 have similar configurations except for lengths in the X direction. Thus, in the following description, the guide unit 24 is described, and description for the guide unit 28 is omitted.

Figure 2:
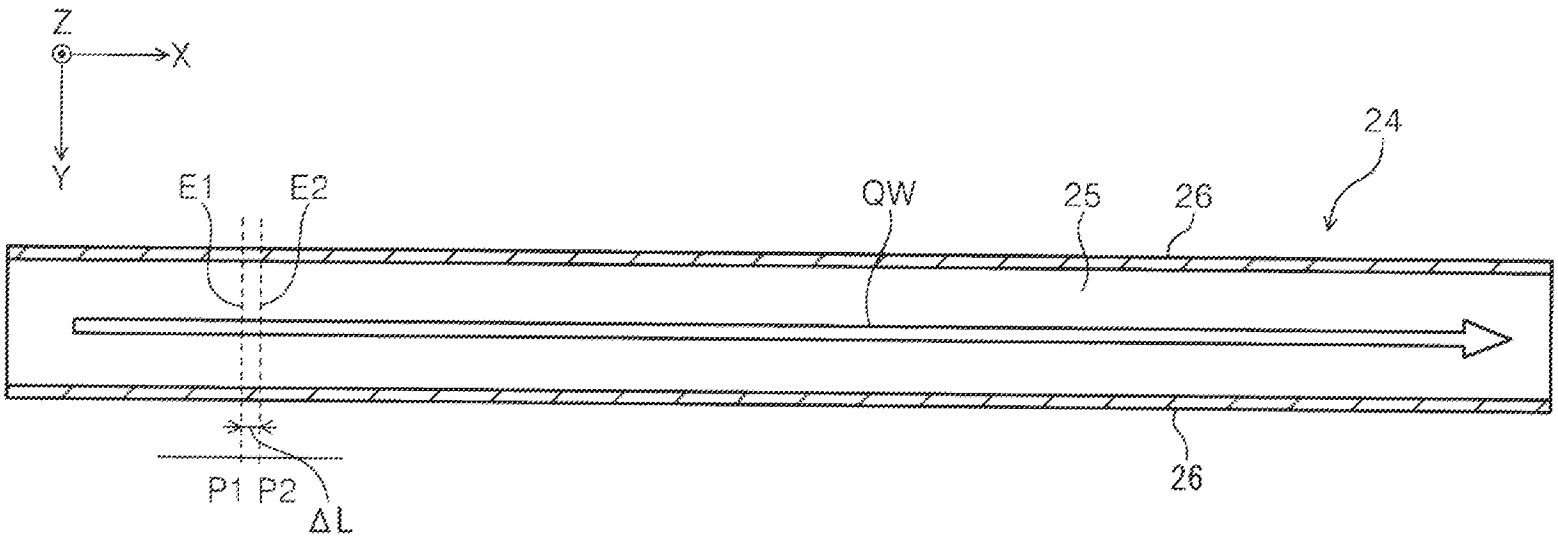
FIG. 2 is a plan view of a guide unit of the first exemplary embodiment.

As illustrated in FIG. 2, as one example, the guide unit 24 has a rectangular outer shape having a dimension in the X direction greater than a dimension in the Y direction. Further, as one example, the guide unit 24 is formed to have a plate-like shape having a predetermined thickness in the Z direction. The guide unit 24 can be arranged along an X-Y plane, that is, in a substantially horizontal state, but may be inclined at an angle of −1 degree or −2 degrees with respect to the X direction so that the height is reduced as approaching the maintenance tank 22 (FIG. 1).

When the guide unit 24 is formed of metal, copper, aluminum, stainless steel, or the like may be used. When the guide unit is formed of a resin, an acrylic resin, polycarbonate, an acrylonitrile butadiene styrene copolymer (ABS), or the like may be used. Note that, in the present exemplary embodiment, as one example, the guide units 24 and 28 are formed through ABS injection molding. Further, metal may be used as a base material of the guide unit 24, and a surface of the metal may be coated with a resin.

Further, as one example, the guide unit 24 includes a receiving surface 25 being an upper surface positioned at an end in the +Z direction and two edge surfaces 26.

The receiving surface 25 is a surface for receiving the waste ink QW. The receiving surface 25 has a rectangular outer shape having a dimension in the X direction greater than a dimension in the Y direction.

Surface energy at a first position P1 on the receiving surface 25 in the X direction with respect to the waste ink QW is indicated as first surface energy E1. Further, surface energy at a second position P2 on the receiving surface 25, which is closer to the maintenance tank 22 (FIG. 1) than the first position P1, with respect to the waste ink QW is indicated as second surface energy E2. In this case, the second surface energy E2 is larger than the first surface energy E1. On the receiving surface 25, as one example, surface energy at each position in the Y direction is substantially the same. Specifically, on the receiving surface 25, the surface energy is successively increased toward the +X direction, but remains substantially the same in the Y direction. Note that the surface energy on the receiving surface 25 is described later.

For easy understanding of the first position P1 and the second position P2, FIG. 2 illustrates an interval ΔL between the first position P1 and the second position P2 in the X direction in an enlarged manner. The length of the interval ΔL is set so as to be equal to or smaller than the length of the ink droplet D (FIG. 3) in the X direction. A range in which the length of the interval ΔL remains equal to or smaller than the length of the ink droplet D in the X direction is indicated as a "range in which the surface energy on the receiving surface 25 successively changes". In the present exemplary embodiment, as one example, the surface energy on the receiving surface 25 successively changes over the entire receiving surface 25 in the X direction.

One of the two edge surfaces 26 is positioned on an outer side of the receiving surface 25 in the +Y direction, and the other one of the two edge surfaces 26 is positioned on an outer side of the receiving surface 25 in the −Y direction. In other words, the two edge surfaces 26 form both edges of the guide unit 24 in the Y direction. Each of the two edge surfaces 26 has a rectangular outer shape having a dimension in the X direction greater than a dimension in the Y direction. The length of the edge surface 26 in the Y direction is smaller than the length of the receiving surface 25 in the Y direction. Surface energy on the edge surface 26 is smaller than the surface energy on the receiving surface 25.

Figure 3:
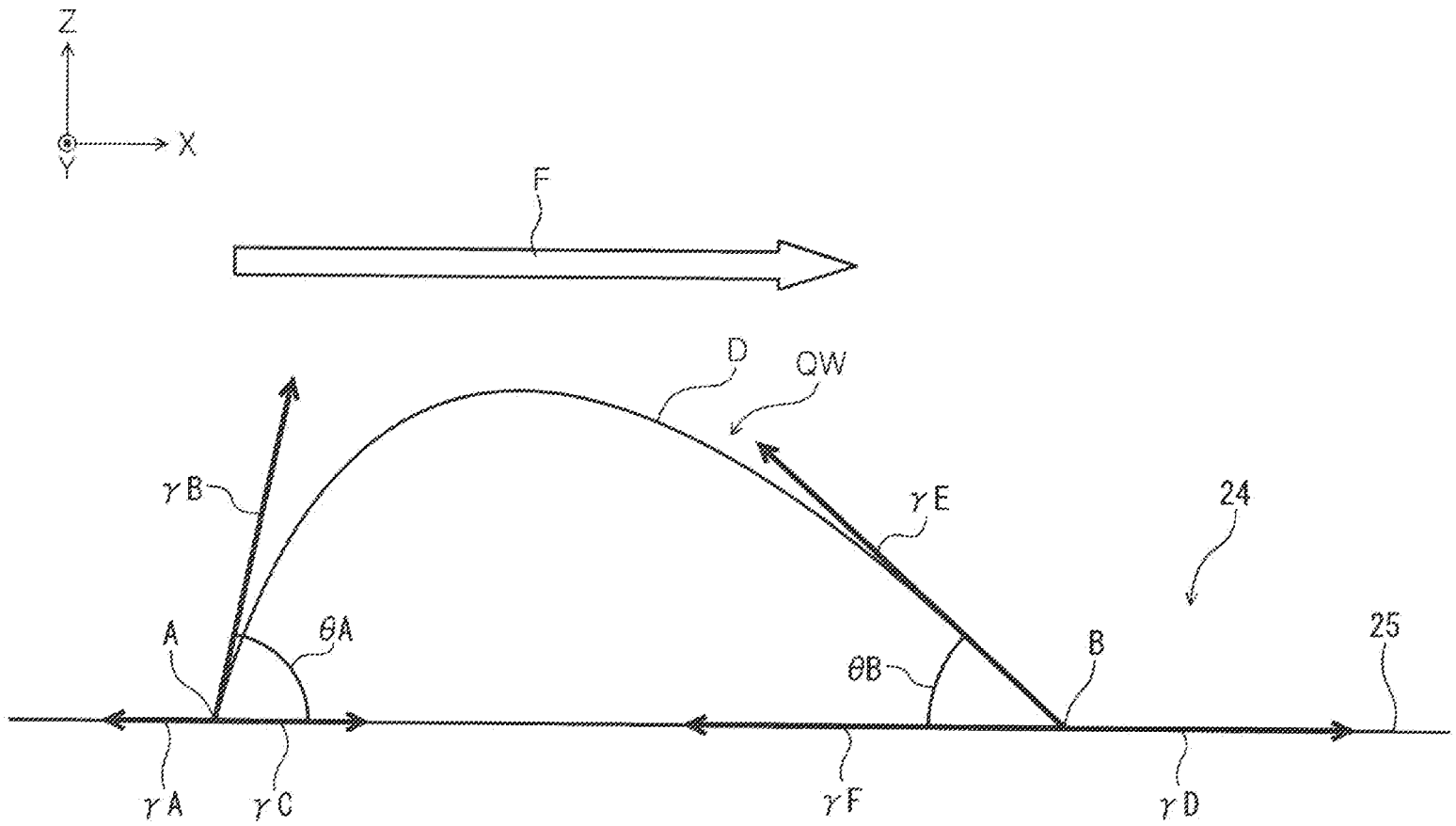
FIG. 3 is a schematic view illustrating wettability of an ink droplet on the guide unit of the first exemplary embodiment.

FIG. 3 schematically illustrates a state in which the ink droplet D contacts with the receiving surface 25.

The surface energy on the receiving surface 25 indicates molecular energy of the receiving surface 25 itself. A unit is mN/m. A wetting phenomenon of the ink droplet D on the receiving surface 25 is determined by balance between the surface energy on the receiving surface 25 and surface tension of the ink droplet D, and is expressed in Young's equation including a contact angle θ.

Equation (1) is satisfied where, at an end point A of the ink droplet D in the −X direction, γA indicates surface energy between the receiving surface 25 and air, γB indicates surface energy between the ink droplet D and air, γC indicates surface energy between the receiving surface 25 and the ink droplet D, and θA indicates a contact angle.

$$\gamma A=\gamma B\times\cos\theta A+\gamma C \quad (1)$$

Equation (2) is satisfied where, at an end point B of the ink droplet D in the +X direction, γD indicates surface energy between the receiving surface 25 and air, γE indicates surface energy between the ink droplet D and air, γF indicates surface energy between the receiving surface 25 and the ink droplet D, and θB indicates a contact angle.

$$\gamma D=\gamma E\times\cos\theta B+\gamma F \quad (2)$$

Here, the end point B is positioned in the +X direction with respect to the end point A, and hence the surface energy at the end point B is larger than the surface energy at the end point A. Thus, balance at the end point A on a boundary surface of the ink droplet D is different from that at the end point B. In this case, γA<γD is given, and hence a driving force F of moving the ink droplet D in the +X direction acts on the ink droplet D. Note that, for easy understanding of illustration in FIG. 3, the surface energy γB between the ink droplet D and air and the surface energy γE between the ink droplet D and air are illustrated to have different magnitudes. However, in actuality, γB=γE is satisfied.

In this manner, in the guide unit 24, the ink droplet D can be moved in the +X direction by using a surface energy difference on the receiving surface 25 in the X direction. Note that, as one example, the surface energy at each part on the receiving surface 25 can be changed by changing a UV irradiation time period for each part on the receiving surface 25. When the guide unit 24 is formed of ABS, a number density of a hydrophilic group generated in the receiving surface 25 is adjusted in accordance with a UV irradiation time period. In this manner, the surface energy at each part of the receiving surface 25 can be changed.

Figure 4:
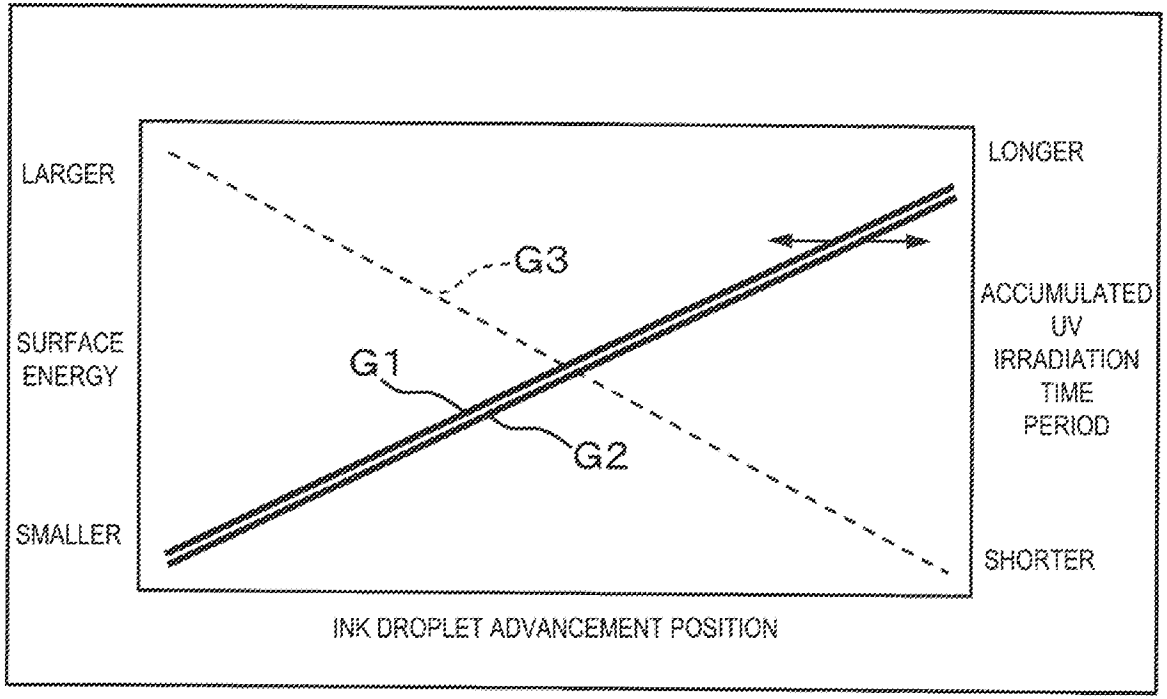
FIG. 4 is a graph showing a relationship between surface energy and an accumulated UV irradiation time period at an ink droplet advancement position of the guide unit of the first exemplary embodiment.

FIG. 4 gives a graph G1, a graph G2, and a graph G3.

The graph G1 shows that the surface energy on the receiving surface 25 (FIG. 3) is increased as an advancement position of the ink droplet D changes in the +X direction.

The graph G2 shows that an accumulated UV irradiation time period on the receiving surface 25 is increased as the advancement position of the ink droplet D changes in the +X direction.

The graph G3 shows that the contact angle θ formed between the ink droplet D and the receiving surface 25 is reduced as the advancement position of the ink droplet D changes in the +X direction.

In this manner, a part of the receiving surface 25 that is irradiated with UV light for a longer time period has larger energy surface and a smaller contact angle θ. In other words, wettability is higher.

Next, with reference to FIG. 1 to FIG. 4, an action of the printer 10 is described.

In the printer 10, the waste ink QW that is not used for recording on the medium M is discarded in the discard portion 18. The waste ink QW flowing out from the discard portion 18 and arriving at the receiving surface 25 is easily guided in the +X direction because the driving force F acts on the receiving surface 25 from the first position P1 having small surface energy to the second position P2 having large surface energy. In other words, the waste ink QW receives the driving force F from the end of the receiving surface 25 in the −X direction to the end thereof in the +X direction. With this, even when inclination of the guide unit 24 with respect to the X direction is reduced, the waste ink QW can be guided to the maintenance tank 22. Thus, the dimension of the printer 10 in the Z direction can be reduced as compared to a case in which the waste ink QW is guided by increasing the inclination angle of the guide unit 24.

Further, in the printer 10, the edge surfaces 26 are positioned on both the outer sides of the receiving surface 25 in the Y direction. Further, the surface energy on the edge surface 26 is smaller than the surface energy on the receiving surface 25. Here, when the receiving surface 25 is inclined in a direction intersecting with the Y direction due to a mounting error of the guide unit 24, the waste ink QW on the receiving surface 25 may move in a direction intersecting with the +X direction due to its own weight. Specifically, part of the waste ink QW moving in the direction intersecting with the +X direction may move toward the edge surface 26.

Here, the surface energy on the edge surface 26 is smaller than the surface energy on the receiving surface 25. Thus, on the part of the waste ink QW arriving at the boundary between the receiving surface 25 and the edge surface 26, the driving force F allowing the part to move beyond the edge surface 26 does not act. With this, without providing both the ends of the receiving surface 25 in the Y direction with a rib extending in the +Z direction, the waste ink QW can be prevented from flowing down from the guide unit 24 to the outer sides in the Y direction. Therefore, as compared to a case in which a rib or the like extending from the receiving surface 25 in the +Z direction is provided, the dimension of the guide unit 24 in the Z direction is reduced. With this, the dimension of the printer 10 in the Z direction can further be reduced.

Second Exemplary Embodiment

Next, with reference to the attached drawings, a printer 30 of a second exemplary embodiment is described. Note that the parts that are shared in common with the printer 10 of the first exemplary embodiment are denoted with the same reference symbols, and description therefor is omitted.

The printer 30 of the second exemplary embodiment is different from the printer 10 of the first exemplary embodiment in that a guide unit 32 is provided in place of the guide unit 24 (FIG. 1). The configuration other than the guide unit 32 is basically similar to the configuration in the first exemplary embodiment.

Figure 5:
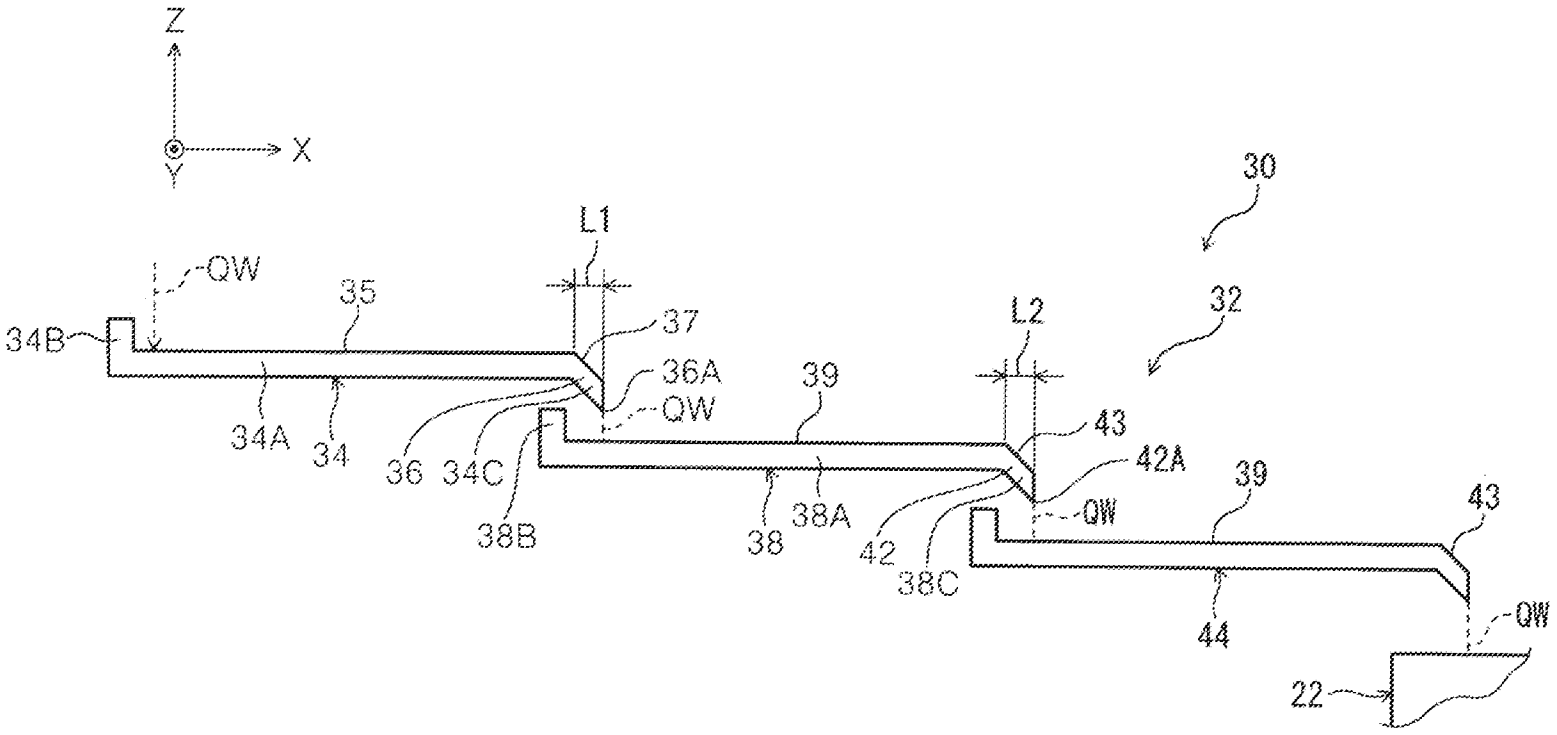
FIG. 5 is a side view of a guide unit of a second exemplary embodiment.

As illustrated in FIG. 5, as one example, the guide unit 32 includes a first guide member 34, a second guide member 38, and a third guide member 44 that are aligned in the X direction.

The +X direction is one example of a guide direction in which the waste ink QW is guided from the first position P1 to the second position P2 (FIG. 2). The −Z direction is one example of a gravitational direction in which a gravitational force acts on the waste ink QW.

The second guide member 38 is positioned below the first guide member 34 in the Z direction. The third guide member 44 is positioned below the second guide member 38 in the Z direction.

The first guide member 34 receives the waste ink QW from the discard portion 18 (FIG. 1). The third guide member 44 moves the waste ink QW to the maintenance tank 22. Note that, as one example, the second guide member 38 and the third guide member 44 have similar configurations except for arrangement. Thus, a configuration of the first guide member 34 and a configuration of the second guide member 38 are described, and description for a configuration of the third guide member 44 is omitted.

The first guide member 34 is one example of a first guide unit. The first guide member 34 includes a flat portion 34A, a vertical wall portion 34B, and an edge portion 34C.

The flat portion 34A is formed to have a plate-like shape having a predetermined thickness in the Z direction. The flat portion 34A has a rectangular outer shape having a dimension in the X direction greater than a dimension in the Y direction. A receiving surface 35 is formed at an end of the flat portion 34A in the +Z direction.

The receiving surface 35 is one example of a first receiving surface. Further, the receiving surface 35 has a similar configuration to the receiving surface 25 (FIG. 2) except for lengths in the X direction.

The vertical wall portion 34B stands upright in the +Z direction at an end of the flat portion 34A in the −X direction. The vertical wall portion 34B prevents part of the waste ink QW flowing down to the flat portion 34A to flow out in the −X direction.

The edge portion 34C forms a downstream end of the first guide member 34 in the +X direction. Further, the edge portion 34C includes a curved portion 36.

The curved portion 36 is a portion that is curved from an end of the flat portion 34A in the +X direction to a receiving surface 39 described later. As one example, the curved portion 36 extends to a position in the +X direction and a position in the −Z direction. Specifically, the curved portion 36 extends in an oblique direction intersecting with the Z direction.

A receiving surface 37 is formed at an end of the curved portion 36 in the +Z direction. The receiving surface 37 has a similar configuration to the receiving surface 35 except for arrangement, and is continuous with the receiving surface 35. Further, the receiving surface 37 is an inclination surface inclined with respect to the X direction.

An end 36A of the curved portion 36 is positioned at an end of the curved portion 36 in the −Z direction. The end 36A is at a position away from the receiving surface 39 in the +Z direction. In other words, the first guide member 34 and the second guide member 38 are positioned at an interval in the Z direction.

The second guide member 38 is one example of a second guide unit. The second guide member 38 includes a flat portion 38A, a vertical wall portion 38B, and an edge portion 38C.

The flat portion 38A is formed to have a plate-like shape having a predetermined thickness in the Z direction. The flat portion 38A has a rectangular outer shape having a dimension in the X direction greater than a dimension in the Y direction. The receiving surface 39 is formed at an end of the flat portion 38A in the +Z direction.

The receiving surface 39 is one example of a second receiving surface. Further, the receiving surface 39 has a similar configuration to the receiving surface 25 (FIG. 2) except for lengths in the X direction.

The vertical wall portion 38B stands upright in the +Z direction at an end of the flat portion 38A in the −X direction. The vertical wall portion 38B prevents part of the waste ink QW flowing down to the flat portion 38A to flow out in the −X direction.

The edge portion 38C forms a downstream end of the second guide member 38 in the +X direction. Further, the edge portion 38C includes a curved portion 42.

The curved portion 42 is a portion that is curved from an end of the flat portion 38A in the +X direction to the third guide member 44. As one example, the curved portion 42 extends to a position in the +X direction and the −Z direction. Specifically, the curved portion 42 extends in an oblique direction intersecting with the Z direction.

A receiving surface 43 is formed at an end of the curved portion 42 in the +Z direction. The receiving surface 43 is a surface for receiving the waste ink QW. Further, the receiving surface 43 has a similar configuration to the receiving surface 39 except for arrangement, and is continuous with the receiving surface 39. Further, the receiving surface 43 is an inclination surface inclined with respect to the X direction.

An end 42A of the curved portion 42 is positioned at an end of the curved portion 42 in the −Z direction. The end 42A is at a position away from the third guide member 44 in the +Z direction. In other words, the second guide member 38 and the third guide member 44 are positioned at an interval in the Z direction.

The edge portion 34C overlaps with the receiving surface 39 in plan view in the −Z direction. Similarly, the edge portion 38C overlaps with a part of the third guide member 44 in plan view in the −Z direction.

In other words, the first guide member 34 and the second guide member 38 overlap with each other over the range of a length L1 in the X direction. The second guide member 38 and the third guide member 44 overlap with each other over the range of a length L2 in the X direction. As one example, L1=L2 is given. Note that, in the present exemplary embodiment, the second guide member 38 and the third guide member 44 overlap with each other over the entire range in the Y direction.

In this manner, the first guide member 34, the second guide member 38, and the third guide member 44 may be arranged in a step-like manner. Note that the first guide member 34, the second guide member 38, and the third guide member 44 may not be arranged at an interval in the Z direction. Specifically, the first guide member 34, the second guide member 38, and the third guide member 44 may be formed of the same material in an integrated manner.

Next, an action of the printer 30 is described.

On the waste ink QW flowing from the discard portion 18 (FIG. 1) to the receiving surface 35, the driving force F in the +X direction (FIG. 3) acts based on a surface energy difference. With this, the waste ink QW passes through the receiving surfaces 35, 37, 39, 43, 39, and 43, and flows to the maintenance tank 22.

The receiving surfaces 37 and 43 are inclination surfaces extending in a direction intersecting with the X direction. Thus, when the waste ink QW flows on the receiving surfaces 37 and 43, a gravitational force acting on the waste ink QW is added to the driving force F of moving the waste ink QW.

In the printer 30, the second guide member 38 and the third guide member 44 are capable of additionally applying a guiding action to the waste ink QW. With this, the waste ink QW can be prevented from stagnating in the middle of the guide unit 32.

In the printer 30, the waste ink QW arriving at the edge portion 34C downstream of the first guide member 34 flows to the receiving surface 39 via the curved portion 36. With this, the waste ink QW from the edge portion 34C downstream of the first guide member 34 in the +X direction can be easily introduced to the receiving surface 39.

In the printer 30, the curved portion 36 and the receiving surface 39, and the curved portion 42 and the receiving surface 39 are away from each other. Thus, the waste ink QW dropping onto the receiving surface 39 does not contact with the plurality of surfaces intersecting with each other. For example, the waste ink QW is prevented from contacting across both a surface of the edge portion 34C along the Z direction and the receiving surface 39. Specifically, for example, when a capillary force acts on the ink droplet D stagnating at a corner portion formed by contact between the surface of the edge portion 34C along the Z direction and the receiving surface 39, a magnitude of the capillary force is greater than the driving force F, and hence the ink droplet D is less likely to move in the +X direction. Alternatively, when surfaces including the surface of the edge portion 34C along the Z direction and the receiving surface 39 have a larger contact area with the ink droplet D than the receiving surface 39 at the instant when the ink droplet D lands on the second guide member 38, the ink droplet D is more likely to wet the surfaces including the surface of the edge portion 34C along the Z direction and the receiving surface 39 than the receiving surface 39. Thus, the ink droplet D is less likely to move in the +X direction. The curved portion 36 and the receiving surface 39, and the curved portion 42 and the receiving surface 39 are away from each other, and hence movement of the waste ink QW dropping onto the receiving surface 39 is less likely to be prevented. Thus, the waste ink QW from the first guide member 34 in the +X direction can be easily introduced to the receiving surface 39.

Modification Example

Next, with reference to the attached drawings, a printer 50 in a modification example of the second exemplary embodiment is described. Note that the parts that are shared in common with the printer 10 of the first exemplary embodiment and the printer 30 of the second exemplary embodiment are denoted with the same reference symbols, and description therefor is omitted.

The printer 50 in the modification example is provided with a guide unit 52 in place of the guide unit 32 (FIG. 5) of the printer 30 of the second exemplary embodiment. The configuration other than the guide unit 52 is basically similar to the configuration in the second exemplary embodiment.

Figure 6:
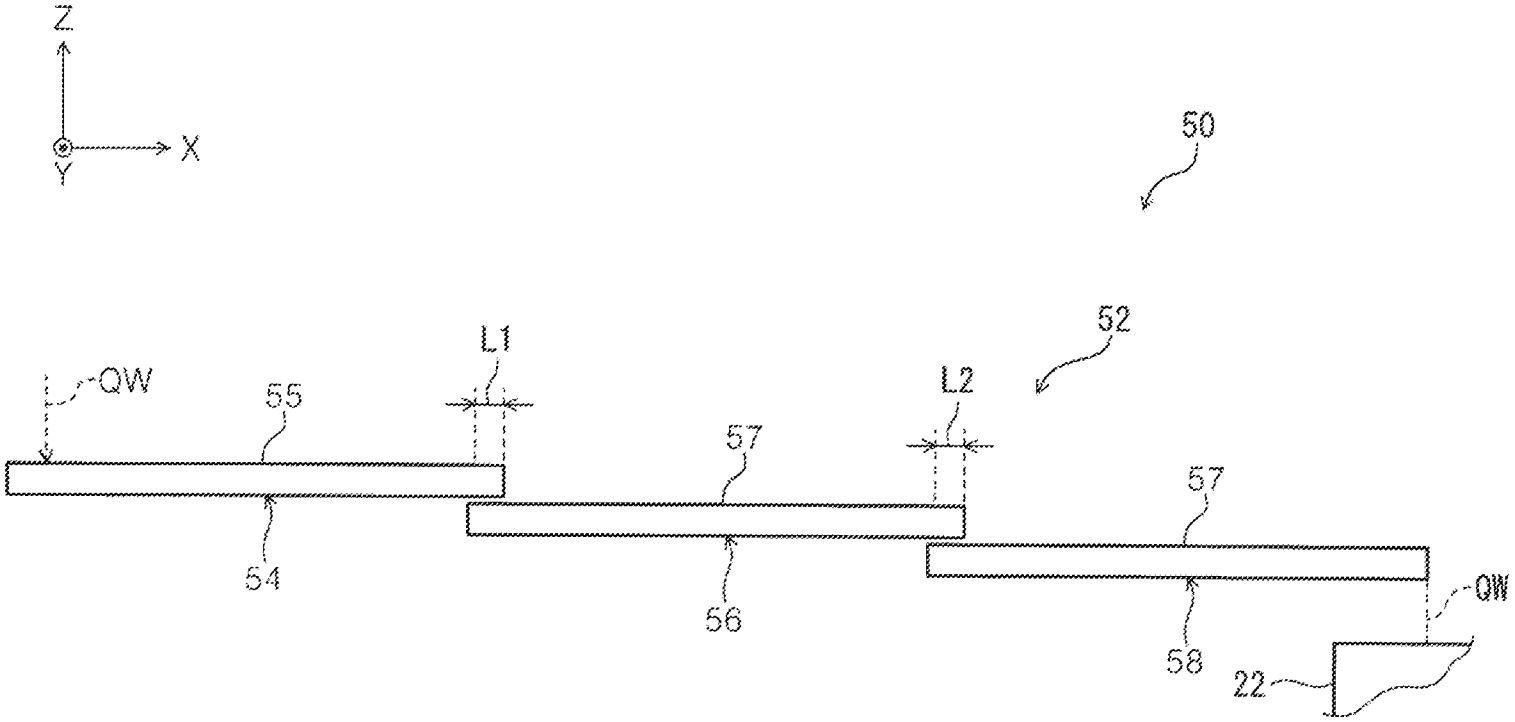
FIG. 6 is a side view of a guide unit in a modification example of the second exemplary embodiment.

As illustrated in FIG. 6, as one example, the guide unit 52 includes a first guide member 54, a second guide member 56, and a third guide member 58 that are aligned in the X direction. The second guide member 56 is positioned below the first guide member 54 in the Z direction. The third guide member 58 is positioned below the second guide member 56 in the Z direction.

The first guide member 54 receives the waste ink QW from the discard portion 18 (FIG. 1). The third guide member 58 moves the waste ink QW to the maintenance tank 22. Note that as one example, the second guide member 56 and the third guide member 58 have similar configurations except for arrangement. Thus, a configuration of the first guide member 54 and a configuration of the second guide member 56 are described, and description for a configuration of the third guide member 58 is omitted.

The first guide member 54 is one example of a first guide unit, and is formed to have a plate-like shape having a predetermined thickness in the Z direction. As viewed in the Z direction, the first guide member 54 has a rectangular outer shape having a dimension in the X direction greater than a dimension in the Y direction. A receiving surface 55 is formed at an end of the first guide member 54 in the +Z direction. The receiving surface 55 is one example of a first receiving surface. Further, the receiving surface 55 has a similar configuration to the receiving surface 35 (FIG. 5). The first guide member 54 and the second guide member 56 are positioned at a slight interval in the Z direction.

The second guide member 56 is one example of a second guide unit, and is formed to have a plate-like shape having a predetermined thickness in the Z direction. As viewed in the Z direction, the second guide member 56 has a rectangular outer shape having a dimension in the X direction greater than a dimension in the Y direction. A receiving surface 57 is formed at an end of the second guide member 56 in the +Z direction. The receiving surface 57 is one example of a second receiving surface. Further, the receiving surface 57 has a similar configuration to the receiving surface 39. The second guide member 56 and the third guide member 58 are positioned at a slight interval in the Z direction.

The first guide member 54 and the second guide member 56 overlap with each other over the range of the length L1 in the X direction. The second guide member 56 and the third guide member 58 overlap with each other over the range of the length L2 in the X direction. In this manner, the first guide member 54, the second guide member 56, and the third guide member 58 each having a flat plate-like shape may be arranged in a step-like manner.

In the printer 50, the second guide member 56 and the third guide member 58 are capable of additionally applying a guiding action to the waste ink QW. With this, the waste ink QW can be prevented from stagnating in the middle of the guide unit 52.

Note that the first guide member 54, the second guide member 56, and the third guide member 58 may not be arranged at an interval in the Z direction. Specifically, the first guide member 54, the second guide member 56, and the third guide member 58 may be formed of the same material in an integrated manner.

Third Exemplary Embodiment

Next, with reference to the attached drawings, a printer 60 of a third exemplary embodiment is described. Note that the parts that are shared in common with the printer 10 of the first exemplary embodiment are denoted with the same reference symbols, and description therefor is omitted.

The printer 60 of the third exemplary embodiment is different from the printer 10 of the first exemplary embodiment in that an electric unit 62 and a heating unit 66 are further included. The configuration other than the electric unit 62 and the heating unit 66 is basically similar to the configuration in the first exemplary embodiment. Note that wettability of the waste ink QW on the receiving surface 25 has such property that, when a temperature rises, wettability on the receiving surface 25 is higher.

Figure 7:
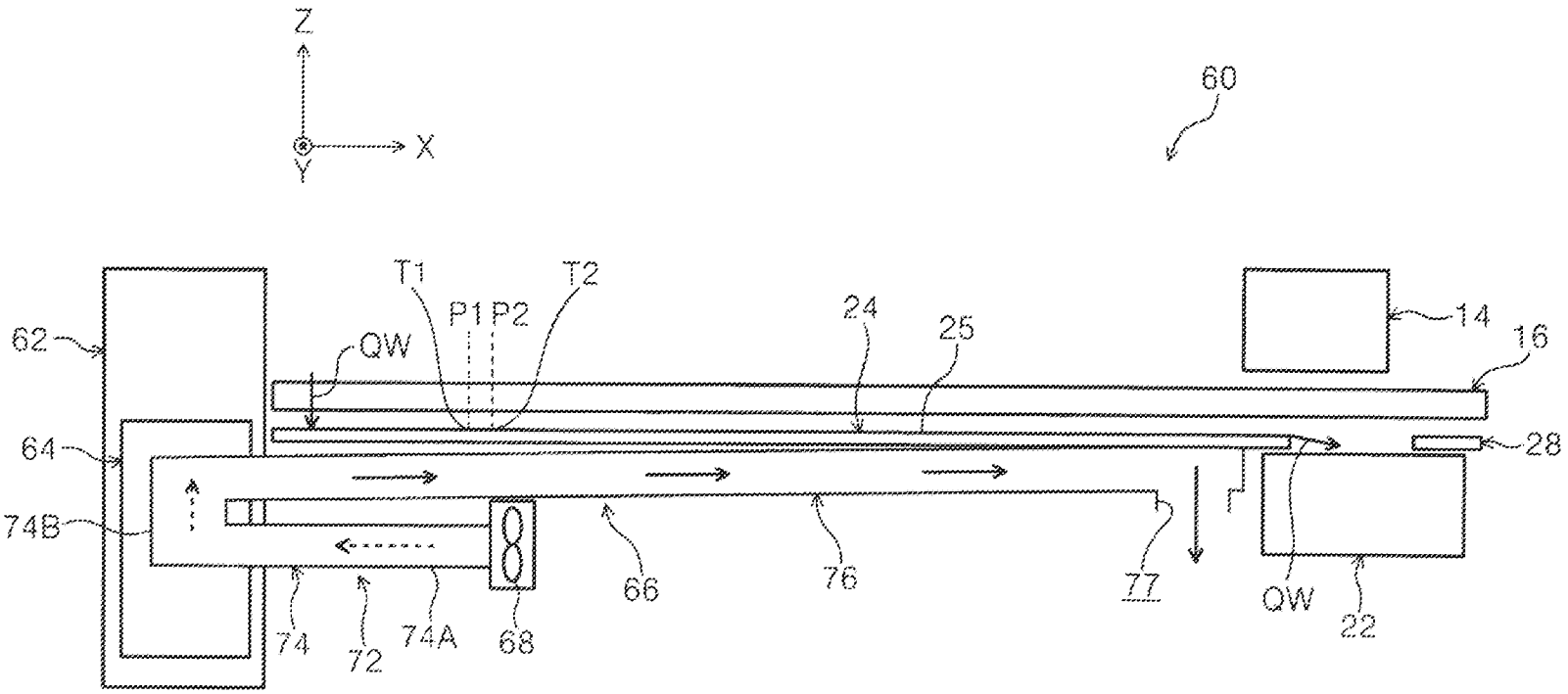
FIG. 7 is a front view illustrating an outline of a printer of a third exemplary embodiment.

As illustrated in FIG. 7, as one example, the electric unit 62 is arranged at a position in the −X direction with respect to the platen unit 16 and the guide unit 24. Further, the electric unit 62 is provided with a control unit 64.

The control unit 64 electrically controls an operation of each of the units, including the recording unit 14, of the printer 60. The control unit 64 includes electronic components and circuit members (not illustrated), and generates heat when current is applied. In other words, the electric unit 62 discharges heat to the outside of the electric unit 62 during operation.

As one example, the heating unit 66 includes an air blowing fan 68 and a duct unit 72.

The control unit 64 controls presence or absence of a rotary operation of the air blowing fan 68. Further, as one example, the air blowing fan 68 rotates to perform air blowing in the −X direction.

The duct unit 72 includes a first duct 74 and a second duct 76.

The first duct 74 includes a guide duct 74A extending in the −X direction from the air blowing fan 68 to the control unit 64 and a cooling duct 74B extending in the +Z direction from an end of the guide duct 74A in the −X direction and contacting with the control unit 64. Specifically, the first duct 74 guides, to the control unit 64, air sent by rotation of the air blowing fan 68.

A temperature of air flowing inside the first duct 74 is lower than a heat generation temperature of the control unit 64. Thus, the control unit 64 contacting with the cooling duct 74B is cooled. In other words, air inside the cooling duct 74B is heated by heat transmission from the control unit 64. Here, when rotation of the air blowing fan 68 is continued, heated air is sent to the second duct 76.

Note that, in FIG. 7, a dotted line arrow indicates an air flow for cooling the control unit 64, and a solid line arrow indicates an air flow for heating the guide unit 24.

The second duct 76 is one example of an imparting unit. Further, the second duct 76 extends from an end of the cooling duct 74B in the +Z direction to the end of the guide unit 24 in the +X direction. As one example, the second duct 76 is arranged to be inclined in a direction intersecting with the X direction so that an interval with the guide unit 24 in the Z direction is reduced as approaching the end of the guide unit 24 in the +X direction. An exhaust port 77 is formed in an end of the second duct 76 in the +X direction.

A temperature of air flowing inside the second duct 76 is lowered by natural cooling as moving in the +X direction. As a position changes in the +X direction, the interval between the second duct 76 and the guide unit 24 in the Z direction is reduced. Thus, the guide unit 24 is heated by the second duct 76, and a temperature gradually rises from the upstream to the downstream in the +X direction. In this manner, the second duct 76 imparts, to the guide unit 24, at least part of heat discharged from the electric unit 62.

Specifically, the heating unit 66 is capable of heating the guide unit 24 so that a second temperature T2 is higher than a first temperature T1 when the first temperature T1 [degrees Celsius] indicates a temperature of the receiving surface 25 at the first position P1 and the second temperature T2 [degrees Celsius] indicates a temperature of the receiving surface 25 at the second position P2. Note that the heating unit 66 is not limited to the above-mentioned configuration. For example, a heating unit including a tube heater may be provided. The heating unit may be configured to heat the guide unit 24 so that the second temperature T2 is higher than the first temperature T1. Further, the imparting unit is not limited to the second duct 76. For example, the electric unit 62 may be arranged at a position in the −Z direction with respect to the end of the guide unit 24 in the +X direction, and a metal heat sink may be provided to the electric unit 62. In this case, when the heat sink is brought into contact with the end of the guide unit 24 in the +X direction from the −Z direction, the heat sink functions as the imparting unit.

Next, an action of the printer 60 is described.

During an operation of the printer 60, the air blowing fan 68 is rotated, and hence the control unit 64 is cooled. Further, when air heated by heat discharged from the control unit 64 flows through the second duct 76 in the +X direction, the receiving surface 25 of the guide unit 24 is gradually heated.

The receiving surface 25 has a higher temperature toward the +X direction. Thus, with regard to the ink droplet D of the waste ink QW contacting with (FIG. 3) the receiving surface 25, part thereof in the +X direction has lower surface tension, that is, higher wettability than part thereof in the −X direction. With this, the driving force F (FIG. 3) acting on the ink droplet D in the +X direction is increased, and hence the waste ink QW easily flows in the +X direction.

In this manner, in the printer 60, the waste ink QW has such property that, when a temperature rises, wettability on the receiving surface 25 is higher. Here, when the guide unit 24 is heated by the heating unit 66, the second temperature T2 at the second position P2 close to the maintenance tank 22 is higher than the first temperature T1 at the first position P1 away from the maintenance tank 22. With this, as approaching the maintenance tank 22, the waste ink QW is more likely to wet the receiving surface 25. Thus, the waste ink QW can be easily introduced to the maintenance tank 22.

In the printer 60, when the control unit 64 in the electric unit 62 controls the recording unit 14, a temperature of the electric unit 62 rises due to heat generation of the control unit 64. Here, the second duct 76 of the heating unit 66 imparts, to the guide unit 24, at least part of heat discharged from the electric unit 62. Then, the guide unit 24 is heated. With this, an additional heating source is not required for heating the guide unit 24, and hence energy consumption in the printer 60 can be reduced.

Fourth Exemplary Embodiment

Next, with reference to the attached drawings, a printer 80 of a fourth exemplary embodiment is described. Note that the parts that are shared in common with the printer 10 of the first exemplary embodiment are denoted with the same reference symbols, and description therefor is omitted.

The printer 80 of the fourth exemplary embodiment is different from the printer 10 of the first exemplary embodiment in that a guide unit 82 is included in place of the guide unit 24. The configuration other than the guide unit 82 is basically similar to the configuration in the first exemplary embodiment.

Figure 8:
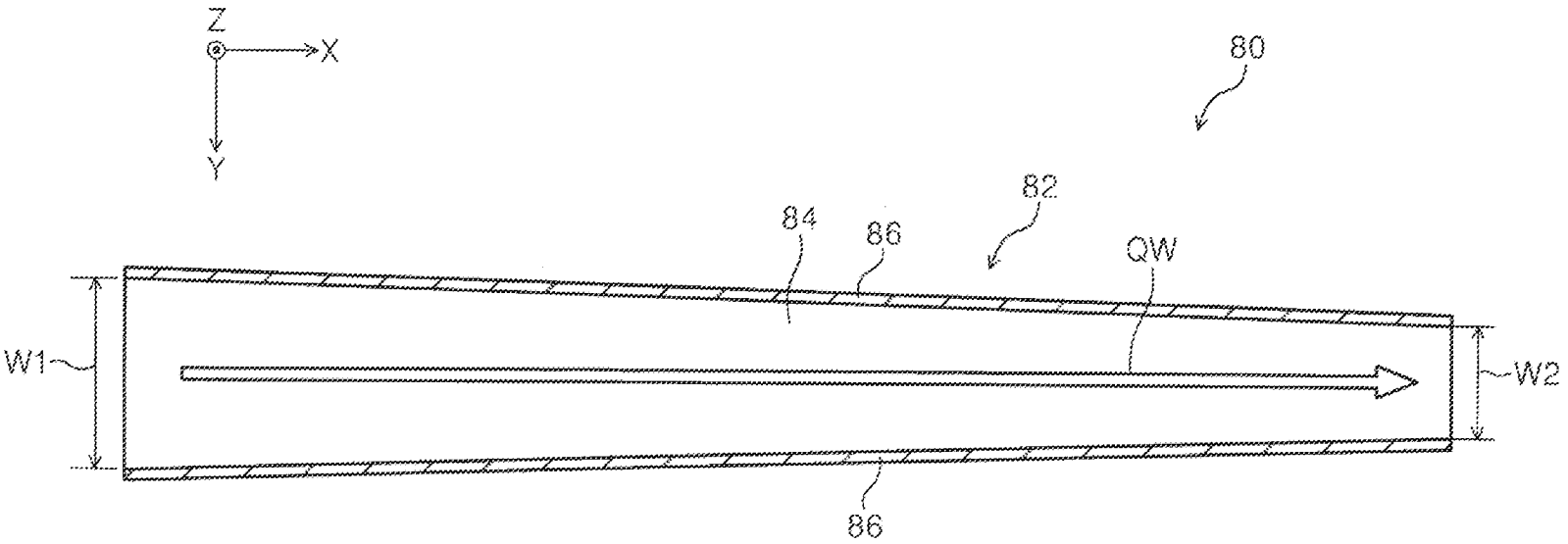
FIG. 8 is a plan view of a guide unit of a fourth exemplary embodiment.

As illustrated in FIG. 8, as one example, the guide unit 82 is formed to have an isosceles trapezoid as viewed in the Z direction. Further, the guide unit 82 includes a receiving surface 84 positioned at an end in the +Z direction and two edge surfaces 86. Note that the Y direction is one example of an intersecting direction intersecting with the +X direction in which the waste ink QW flows. Specifically, a width of the receiving surface 84 in the Y direction is reduced from the upstream to the downstream in the +X direction. Specifically, W1>W2 is given when W1 indicates a width in the Y direction at an end of the receiving surface 84 in the −X direction and W2 indicates a width in the Y direction at an end of the receiving surface 84 in the +X direction. The material of the receiving surface 84 is the same as the receiving surface 25 (FIG. 2). In other words, the width W2 in the Y direction at the second position P2 on the receiving surface 84 is smaller than the width W1 in the Y direction at the first position P1 on the receiving surface 84.

The two edge surfaces 86 are positioned on outer sides of the receiving surface 84 in the +Y direction and the −Y direction. In other words, the two edge surfaces 86 form both edges of the guide unit 82 in the Y direction. As viewed in the Z direction, each of the two the two edge surfaces 86 is formed to have a parallelogram shape. The width of the edge surface 86 in the Y direction is smaller than the width of the receiving surface 84 in the Y direction. The material of the edge surface 86 is the same as the edge surface 26 (FIG. 2).

Next, an action of the printer 80 is described.

In the printer 80, the waste ink QW flowing on the receiving surface 84 is gathered and forms larger unity as approaching the downstream end of the receiving surface 84 in the +X direction. Thus, the waste ink QW easily flows. With this, as compared to a configuration in which the receiving surface 84 has a rectangular outer shape, the waste ink QW can further be prevented from stagnating at a part of the receiving surface 84.

The printers 10, 30, 50, 60, and 80 according to the exemplary embodiments and the modification example of the present disclosure are based on the configurations described above. However, as a matter of course, modifications, omission, and the like may be made to a partial configuration without departing from the gist of the disclosure of the present application.

In each of the printers 10, 30, 50, 60, and 80, when the medium M to be used has a plurality of sizes, the discard portion 18 may be provided not only to two locations, but also to three or more locations.

In the printer 10, when the maintenance tank 22 is at a position facing one of the two corner portions of the guide unit 24 in the +X direction, the direction in which the surface energy on the receiving surface 25 changes may be, for example, a diagonal direction instead of the +X direction. Further, the receiving surface 25 is not limited to a flat surface, and may have an inclination surface or a curved surface for gathering the waste ink QW on a part thereof.

In the printer 30, when the guide unit 32 is divided into a plurality of guide members, the number of guide members is not limited to three, and may be two, or four or more. Alternatively, the guide unit 32 may not be divided into a plurality of guide members, but may form one guide member by coupling a plurality of receiving surfaces through intermediation of inclination surfaces. The vertical wall portions 34B and 38B may be provided to both the ends of the guide unit 32 in the Y direction.

In the printer 60, the heating unit is not limited to have a configuration of utilizing discharged heat, and may have a configuration of direct heating such as a heat transmission sheet.

The receiving surfaces 25, 35, 37, 39, 43, 55, 57, and 74 may be provided with electrodes, and an electrostatic force may be generated by applying a voltage from a power source to the electrodes. In this manner, the driving force F may be increased.

What is claimed is:

1. A recording device, comprising:

a recording unit configured to eject liquid onto a medium to perform recording on the medium, the medium being transported in a transport direction;

a support unit including a support surface configured to support the medium and a discard portion provided at a position corresponding to an end edge of the medium supported on the support surface in a width direction, the width direction being a direction intersecting with the transport direction of the medium, the discard portion being a portion in which waste liquid being the liquid not used for recording on the medium is discarded;

a recovery unit configured to recover the waste liquid; and a guide unit configured to receive the waste liquid flowing out from the discard portion and guide the waste liquid so that the waste liquid flows toward the recovery unit, wherein the guide unit includes a receiving surface for receiving the waste liquid, and when surface energy at a first position on the receiving surface for the waste liquid is first surface energy, and surface energy at a second position on the receiving surface for the waste liquid is the second surface energy, the second position being closer to the recovery unit than the first position, the second surface energy is larger than the first surface energy.

2. The recording device according to claim 1, further comprising:

a second guide unit including a second receiving surface for receiving the waste liquid when the guide unit is a first guide unit and the receiving surface is a first receiving surface, wherein when a direction in which a gravitational force acts on the waste liquid is a gravitational direction, the second guide unit is positioned below the first guide unit in the gravitational direction, and when a direction in which the waste liquid is guided from the first position to the second position is a guide direction, an edge portion downstream of the first guide unit in the guide direction overlaps with the second receiving surface in plan view in the gravitational direction.

3. The recording device according to claim 2, wherein the edge portion downstream of the first guide unit in the guide direction includes a curved portion being curved toward the second receiving surface.

4. The recording device according to claim 3, wherein an end of the curved portion is at a position away from the second receiving surface.

5. The recording device according to claim 1, wherein wettability of the waste liquid on the receiving surface increases as a temperature rises, and the recording device further comprises a heating unit configured to heat the guide unit so that a second temperature is higher than a first temperature when the first temperature is a temperature at the first position on the receiving surface and the second temperature is a temperature at the second position on the receiving surface.

6. The recording device according to claim 5, comprising:

an electric unit provided with a control unit configured to control the recording unit, wherein the heating unit includes an imparting unit configured to impart, to the guide unit, at least part of exhaust heat from the electric unit.

7. The recording device according to claim 1, wherein when a direction intersecting with a direction in which the waste liquid flows is an intersecting direction, a width in the intersecting direction of the receiving surface at the second position is smaller than a width in the intersecting direction of the receiving surface at the first position.

* * * * *